US011987329B2

(12) United States Patent
Stoter

(10) Patent No.: US 11,987,329 B2
(45) Date of Patent: May 21, 2024

(54) POOL FLOAT

(71) Applicant: VIVERE LTD., Guelph (CA)

(72) Inventor: Jason Stoter, Guelph (CA)

(73) Assignee: VIVERE LTD., Guelph (CA)

( * ) Notice: Subject to any disclaimer, the term of this patent is extended or adjusted under 35 U.S.C. 154(b) by 307 days.

(21) Appl. No.: 17/393,080

(22) Filed: Aug. 3, 2021

(65) Prior Publication Data

US 2022/0009599 A1 Jan. 13, 2022

Related U.S. Application Data

(60) Continuation-in-part of application No. 29/755,312, filed on Oct. 19, 2020, now Pat. No. Des. 926,906, which is a division of application No. 29/722,743, filed on Jan. 31, 2020, now Pat. No. Des. 900,266.

(51) Int. Cl.
*B63B 34/50* (2020.01)
*B63B 5/24* (2006.01)

(52) U.S. Cl.
CPC ..... *B63B 34/50* (2020.02); *B63B 5/24* (2013.01)

(58) Field of Classification Search
CPC ..... B63B 34/50; B63B 5/24; A47C 15/006; A47C 27/088
See application file for complete search history.

(56) References Cited

U.S. PATENT DOCUMENTS

2014/0346824 A1* 11/2014 Harrison ..... A47C 15/006 297/219.1
2016/0272285 A1* 9/2016 Ackerman ..... A01K 29/00

* cited by examiner

*Primary Examiner* — Andrew Polay
(74) *Attorney, Agent, or Firm* — Hodgson Russ LLP

(57) ABSTRACT

A method of assembling a floatation device and a floatation device is disclosed. The method can include providing a casing having an upper fabric layer and a lower porous layer. A plurality of dividers can be connected at a first end to the upper fabric layer and at a second end to the lower porous layer. Edges of the upper fabric layer and the lower fabric layer can be connected by a zipper. The upper fabric layer and the lower fabric layer can define a chamber therebetween, and the plurality of dividers dividing the chamber into a plurality of sleeves. A plurality of foam floatation members can be installed in a respective sleeve of the plurality of sleeves, and the zipper can be closed to form a floatatable platform.

19 Claims, 19 Drawing Sheets

DETAIL B

DETAIL C

DETAIL D

DETAIL E

DETAIL F

DETAIL G

DETAIL H

POOL FLOAT

CROSS-REFERENCE TO RELATED APPLICATION(S)

This application is a continuation-in-part of U.S. application Ser. No. 29/755,312, filed Oct. 19, 2020, which is a divisional of U.S. application Ser. No. 29/722,743, filed on Jan. 31, 2020, the entire disclosures of which are incorporated herein by reference.

FIELD OF THE DISCLOSURE

This disclosure relates to floatation devices capable of supporting body weight.

BACKGROUND OF THE DISCLOSURE

Instead of swimming in a body of water (pool, lake, etc.), which requires limb movement and exposes only portions of their body to sunlight, individuals often want to float on top of the water. This allows an individual to relax their limbs and expose more of their body to sunlight. To achieve this, a floatation device can be provided which supports the weight of the individual to keep their body above the water.

One common floatation device is an inflatable raft. While this type of floatation device is easily transported when deflated, it requires the individual to inflate the device before use. This can be difficult for some individuals. In addition, inflatable rafts are prone to deflating over time, so the individual may need to re-inflate the device periodically.

Another common floatation device substitutes air in the raft with other buoyant materials. For example, the raft may be filled with granular beads. These floatation devices may be pre-filled, which makes their transport more difficult and costly. Alternatively, the floatation devices may be sold empty, with the buoyant materials separate. However, it would be difficult to remove the small granular beads from the raft for transport after the first use.

Yet another common floatation device is a solid raft. These are often made of foam to be lightweight, but are still large and bulky, which impedes their ease of transportation. In addition, solid rafts can become water-logged or degrade over time, which decreases its performance and appearance. This requires the individual to completely replace the floatation device when its condition is deteriorated.

Therefore, what is needed is a floatation device that is easily transportable and does not need to be completely replaced when its condition is deteriorated.

BRIEF SUMMARY OF THE DISCLOSURE

According to an embodiment of the present disclosure, a method of assembling a floatation device can include providing a casing. The casing can include an upper fabric layer, a lower porous layer, and a plurality of dividers. Each of the plurality of dividers can be connected at a first end to the upper fabric layer and at a second end to the lower porous layer. A portion of edges of the upper fabric layer and portion of edges of the lower layer can be fixed together and another portion of edges of the upper fabric layer and the lower fabric layer can be connected by a zipper. The upper fabric layer and the lower fabric layer can define a chamber therebetween. The plurality of dividers can divide the chamber into a plurality of sleeves. A majority of the upper fabric layer is a woven, water-resistant fabric. The lower porous layer can include yarns coated with a synthetic plastic polymer. In one specific example, the synthetic plastic polymer can be polyvinyl chloride. A plurality of foam floatation members can be installed in a respective sleeve of the plurality of sleeves. The zipper can be closed to form a floatatable platform.

According to certain embodiments, the lower porous layer can include apertures that range between 0.5 $mm^2$ and 1.5 $mm^2$. Moreover, the apertures can be defined by spacing adjacent yarns of the yarns of the lower porous layer by a distance greater than 0.75 mm. The upper fabric layer can be a coated nylon or polyester. The plurality of foam floatation members can be tubular. The plurality of foam floatation members can be cut prior to inserting each of the plurality of foam floatation members in the respective sleeve of the plurality of sleeves.

According to another embodiment of the present disclosure, a floatation device is provided. The flotation device can have a casing that includes an upper fabric layer, a lower porous layer, opposite to the upper fabric layer, and a plurality of dividers. Each of the plurality of dividers can be connected at a first end to the upper fabric layer and at a second end to the lower porous layer. A portion of edges of the upper fabric layer and portion of edges of the lower layer can be fixed together and another portion of edges of the upper fabric layer and the lower fabric layer can be connected by a zipper, the upper fabric layer and the lower fabric layer defining a chamber therebetween, and the plurality of dividers dividing the chamber into a plurality of sleeves.

The casing can be configured to receive a plurality of foam floatation members in the chamber. Each foam floatation member can be positioned in a respective sleeve of the plurality of sleeves, and the plurality of foam floatation members are arranged to form a floating platform.

According to certain embodiments, the plurality of foam floatation members can be arranged longitudinally in the chamber. According to other embodiments, the plurality of foam floatation members can be arranged transversely in the chamber.

In some embodiments, the plurality of foam floatation members can include a first layer of foam floatation members and a second layer of foam floatation members disposed on top of the first layer of foam floatation members. A separation layer can be disposed between the first layer of foam floatation members and the second layer of foam floatation members. The separation layer can be made of the same material as the upper fabric layer, the same as the lower porous layer, or a different fabric than the upper fabric layer or the lower porous layer.

The plurality of dividers can include a first layer of dividers each connected at a first end to the lower porous layer and at a second end to the separation layer, and a second layer of dividers each connected at a first end to the separation layer and at a second end to the upper fabric layer. Each foam floatation member in the first layer of foam floatation members can be adjacent to at least one divider of the first layer of dividers, and each foam floatation member in the second layer of foam floatation members can be adjacent to at least one divider of the second layer of dividers.

In one embodiment, the second layer of foam floatation members can be stacked on the first layer of foam floatation members such that the first layer of foam floatation members and the second layer of foam floatation members are aligned. In another embodiment, the second layer of foam floatation members can be stacked on the first layer of foam floatation members such that the first layer of foam floatation members and the second layer of foam floatation members are offset. In yet another embodiment, the second layer of foam floatation members can be stacked on the first layer of foam floatation members such that the first layer of foam floatation members and the second layer of foam floatation members are orthogonal.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Figure 1:
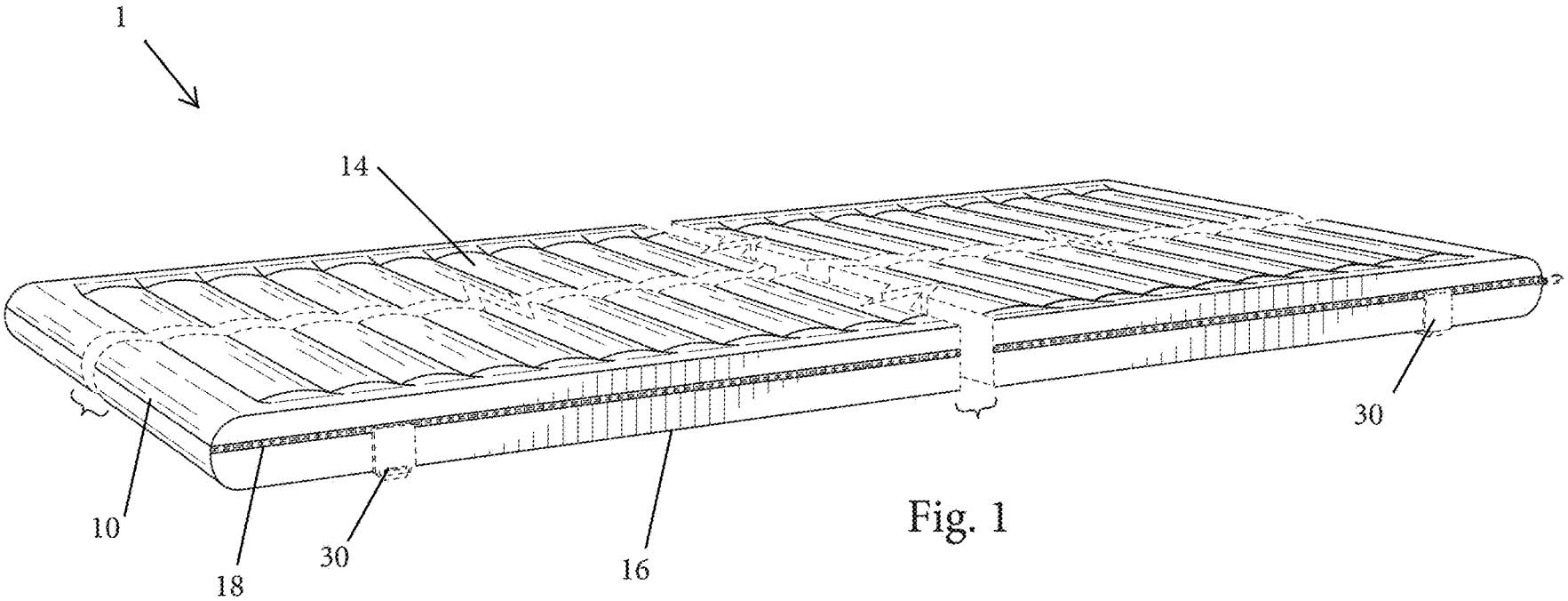
FIG. 1 is a perspective view of a floatation device according to an embodiment of the present disclosure, where the zipper of the floatation device is closed.
Figure 2:
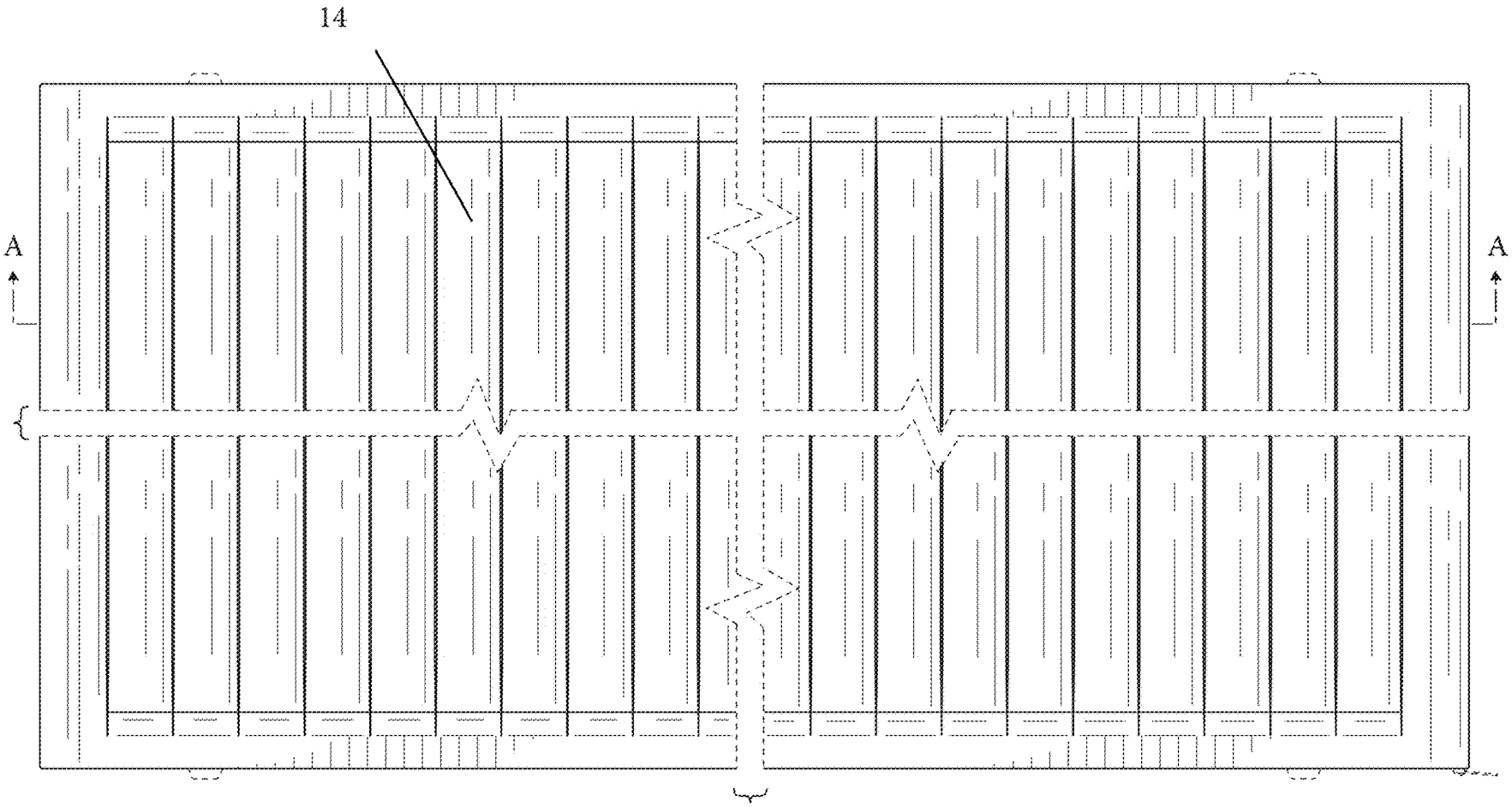
FIG. 2 is top view of the floatation device of FIG. 1.
Figure 3:
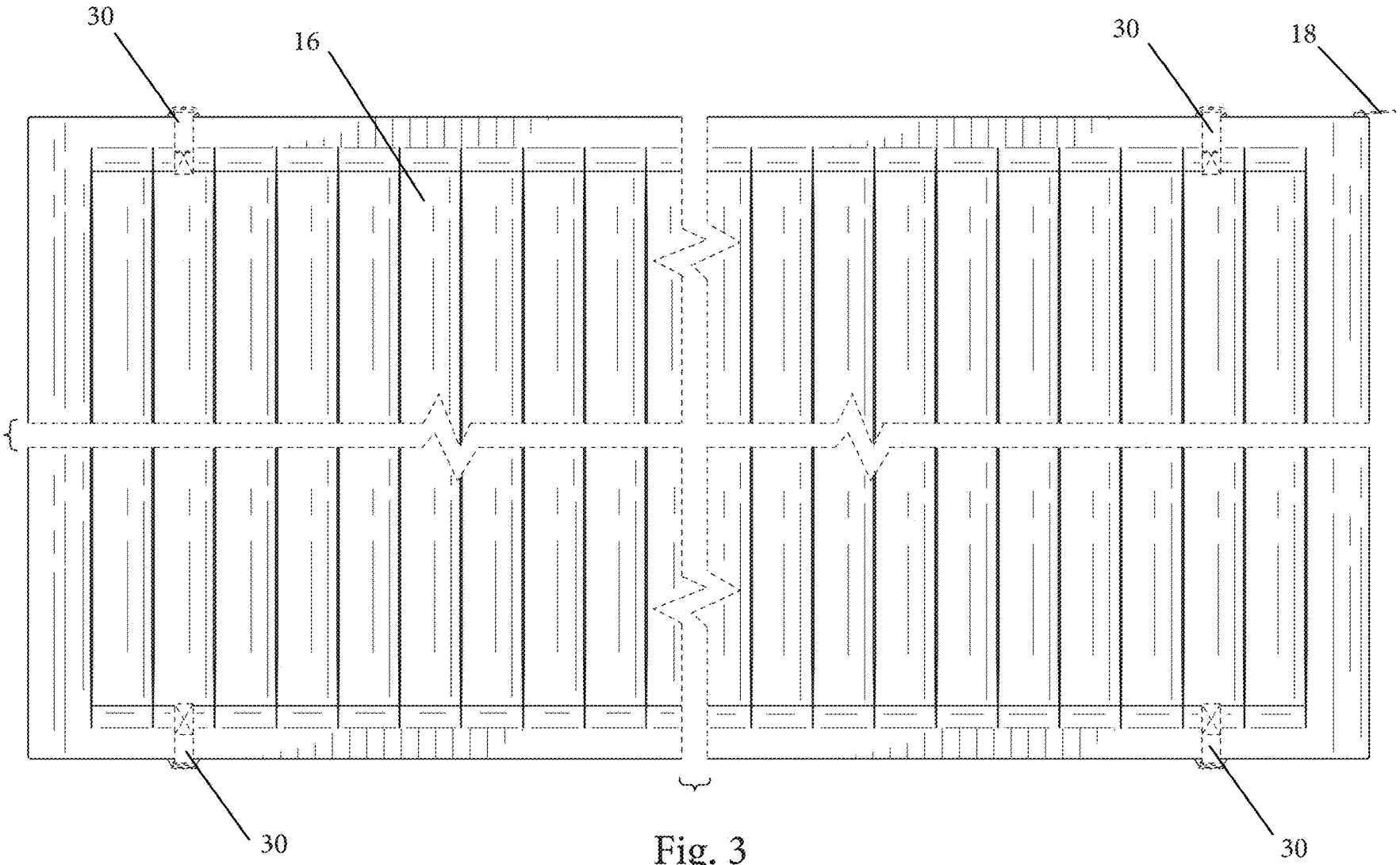
FIG. 3 is a bottom view of the floatation device of FIG. 1.

Although claimed subject matter will be described in terms of certain embodiments, other embodiments, including embodiments that do not provide all of the benefits and features set forth herein, are also within the scope of this disclosure. Various structural, logical, process step, and electronic changes may be made without departing from the scope of the disclosure. Accordingly, the scope of the disclosure is defined only by reference to the appended claims.

With reference to FIGS. 1-6, the present disclosure provides a floatation device 1. The floatation device 1 may comprise a casing 10 that encapsulates a plurality of floatation members 12 therein. The casing 10 may be a substantially rectangular prism (although the casing 10 can have other geometric or irregular shapes), and be large enough to support the body of an adult laying down. For example, the length of the casing 10 may be between 150 cm and 200 cm, the width of the casing may be between 50 cm and 100 cm, and the height can be between 5 cm and 8 cm. In one specific example, the casing 10 can have a length of 178 cm, a width of 66 cm, and a height of 6.5 cm. According to other embodiments, the casing 10 may be large enough to support the bodies of two or more adults laying down. For example, the width of the casing 10 can be roughly double of the above-described dimensions for a single user (e.g. of the casing may be between 100 cm and 200 cm). In one specific example, a "double-sized" casing 10 can have a length of 178 cm, a width of 132 cm, and a height of 6.5 cm. The figures include break lines in the length and width directions to illustrate that a flotation device according to the present disclosure can have various dimensions.

The casing 10 may comprise an upper fabric layer 14. The upper fabric layer 14 may be a fabric that is comfortable for the individual to lay on. The upper fabric layer 14 may be treated to be water-repellent and/or protected from ultraviolet light, such as a treated polyester or a treated nylon material. In one example, the upper fabric layer 14 may be made of or include a plain weave 600 denier polyester fabric coated with a polymer, such as polyurethane.

The casing 10 may further comprise a lower porous layer 16. In certain embodiments, the lower porous layer 16 can be made of, and/or be coated with, a synthetic plastic polymer such as polyvinyl chloride. The lower porous layer 16 may include apertures that range between 0.5 $mm^2$ and 1.5 $mm^2$. The apertures can be defined by spacing adjacent yarns of the yarns of the lower porous layer 16 by a distance greater than 0.75 mm. In one specific embodiment, the lower porous layer 16 is a fabric having yarns that are spaced apart in both warp and weft directions by 1 mm thereby producing 1 $mm^2$ apertures. In this way, the lower porous layer 16 can be water-permeable to allow water to pass therethrough.

A portion of the edges of the upper fabric layer 14 and the lower porous layer 16 may be fixed together. For example, a portion of the edges of the upper fabric layer 14 and the lower porous layer 16 may be sewn, glued, or stapled together. The portion of the edges of the upper fabric layer 14 and the lower porous layer 16 that are fixed together may correspond to one side of the substantially rectangular casing 10. Alternatively, the portion of the edges of the upper fabric layer 14 and the lower porous layer 16 that are fixed together may correspond to two or three sides of the substantially rectangular casing 10.

The remaining edge(s) of the upper fabric layer 14 and the lower porous layer 16 may be connected by a zipper 18. The zipper 18 may allow the upper fabric layer 14 and the lower porous layer 16 to be separated when the zipper 18 is open and connected when the zipper 18 is closed. Alternatively, the remaining edge(s) of the upper fabric layer 14 and the lower porous layer 16 may be connected by other suitable means, such as buttons or snaps.

According to an embodiment of the present disclosure, the portion of the edges of the upper fabric layer 14 and the lower porous layer 16 that are fixed may correspond to one side of the substantially rectangular casing 10, and the remaining edges of the upper fabric layer 14 and the lower porous layer 16 that are connected by a zipper 18 may correspond to the other three sides of the substantially rectangular casing 10. Alternatively, the portion of the edges of the upper fabric layer 14 and the lower porous layer 16 that are fixed may correspond to two or three sides of the substantially rectangular casing 10, and the remaining edges of the upper fabric layer 14 and the lower porous layer 16 that are connected by a zipper 18 may correspond to the other one or two sides of the substantially rectangular casing 10. It should be realized that the zipper 18 could be located at different heights along a side of the casing 10. For example, the zipper 18 could be located at a bottommost edge, in which case, the lower porous layer 16 can be single, planar sheet, and the upper fabric layer 14 can form the top and side edges of the casing 10.

The casing 10 of the present disclosure provides an upper fabric layer 14 and a lower porous layer 16 in which a portion of the edges are fixed and the remaining edges are connected by a zipper 18. Thus, the upper fabric layer 14 and the lower porous layer 16 may define a chamber 11 therebetween.

Figure 4:
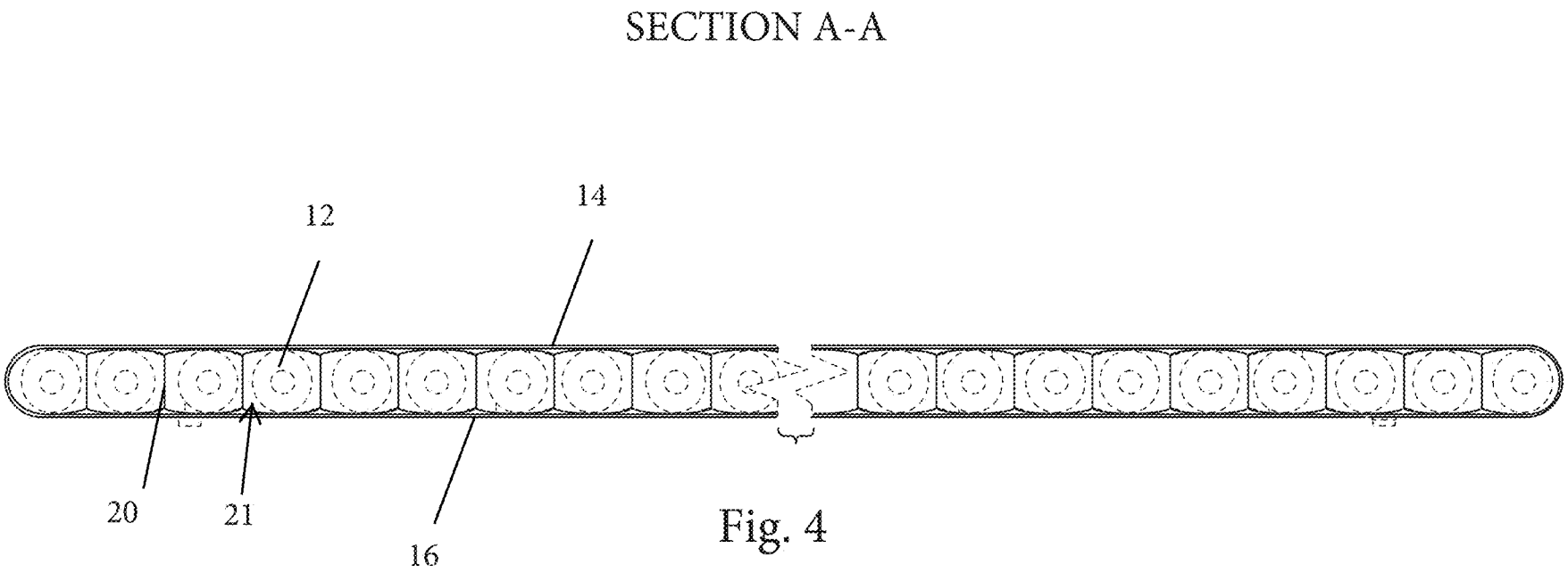
FIG. 4 is a cross-sectional view of the floatation device of FIG. 1 taken along line A-A of FIG. 2.
Figure 5:
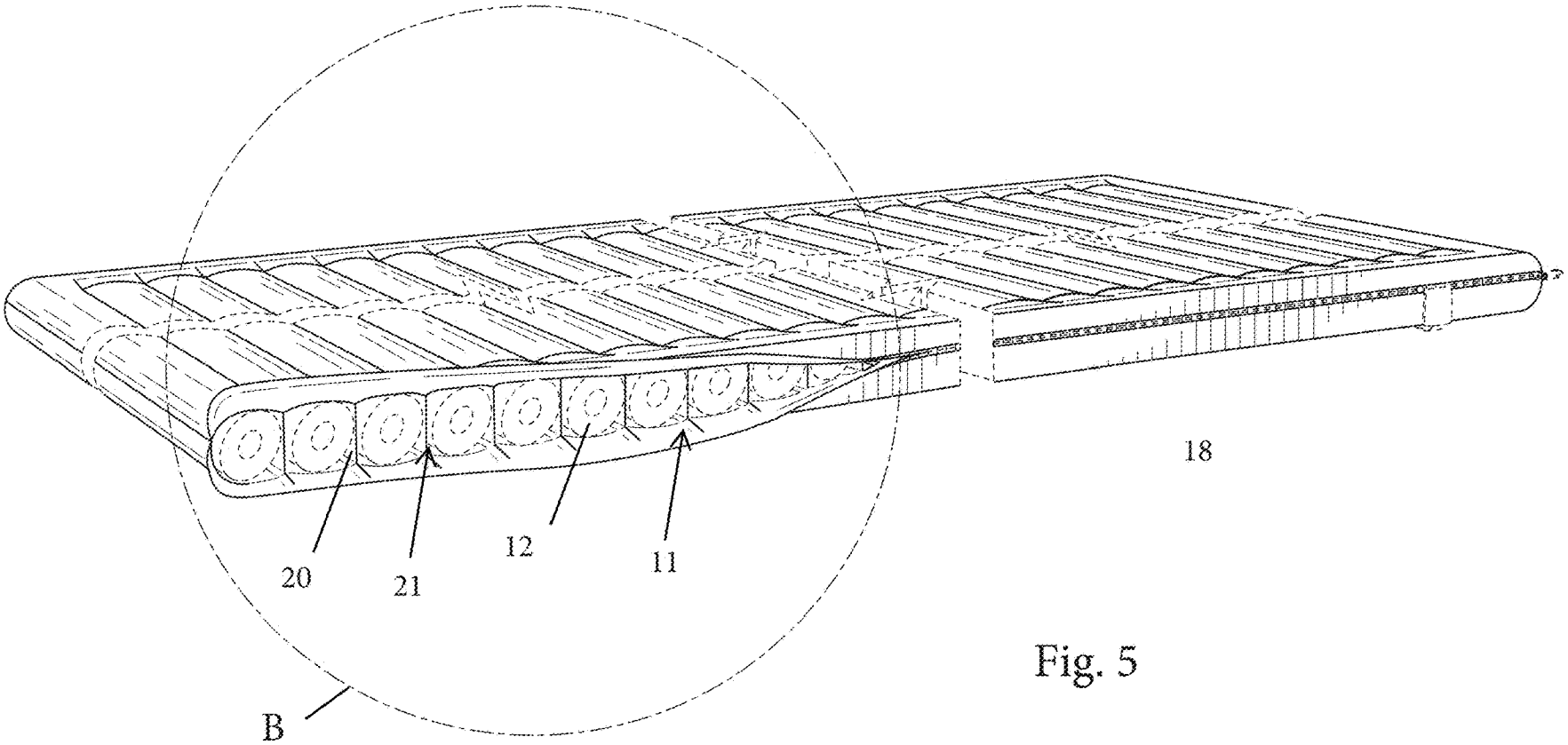
FIG. 5 is a another perspective view of the floatation device of FIG. 1, where the zipper is partially open.
Figure 6:
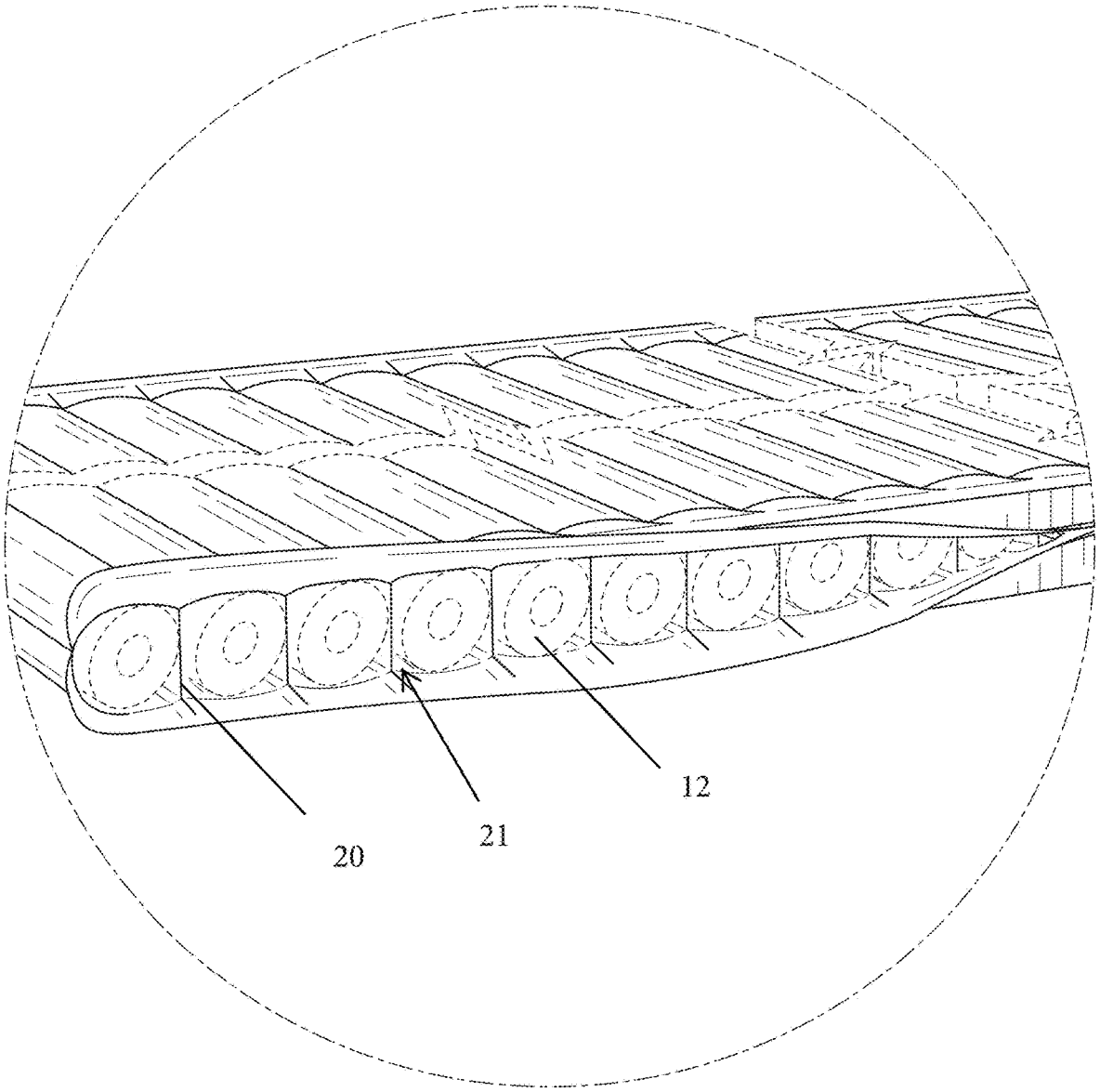
FIG. 6 is a detail view showing area B of FIG. 5.

As shown in FIGS. 4-6, the casing 10 may further comprise a plurality of dividers 20. The plurality of dividers 20 may be a fabric that is the same as the upper fabric layer 14, the same as the lower porous layer 16, or a different fabric than either the upper fabric layer 14 or the lower porous layer 16. Each of the plurality of dividers 20 may be connected at a first end to the upper fabric layer 14 and at a second end to the lower porous layer 16.

The plurality of dividers 20 may be arranged parallel within the casing 10. For example, each of the plurality of dividers 20 may extend the width of the casing 10 and be spaced apart along the length of the casing 10. Alternatively, each of the plurality of dividers 20 may extend the length of the casing 10 and be spaced apart along the width of the casing 10. The plurality of dividers 20 may divide the chamber 11 into a plurality of sleeves 21.

The casing 10 may be configured to receive a plurality of foam floatation members 12 in the chamber 11. The plurality of foam floatation members 12 may be cylindrical or tubular. According to a specific embodiment of the present disclosure, the plurality of foam floatation members 12 may be pool noodles. The plurality of foam floatation members 12 may be positioned in the chamber 11 of the casing 10 between the upper fabric layer 14 and the lower porous layer 16. For example, each of the plurality of foam floatation members 12 may be positioned in each of the plurality of sleeves 21.

The plurality of foam floatation members 12 may be arranged to form a floating platform. For example, the plurality of foam floatation members 12 may be arranged side-by-side within the chamber 11 of the casing 10, with one of the plurality of dividers 20 positioned in between each of the plurality of foam floatation members 12.

Figure 7:
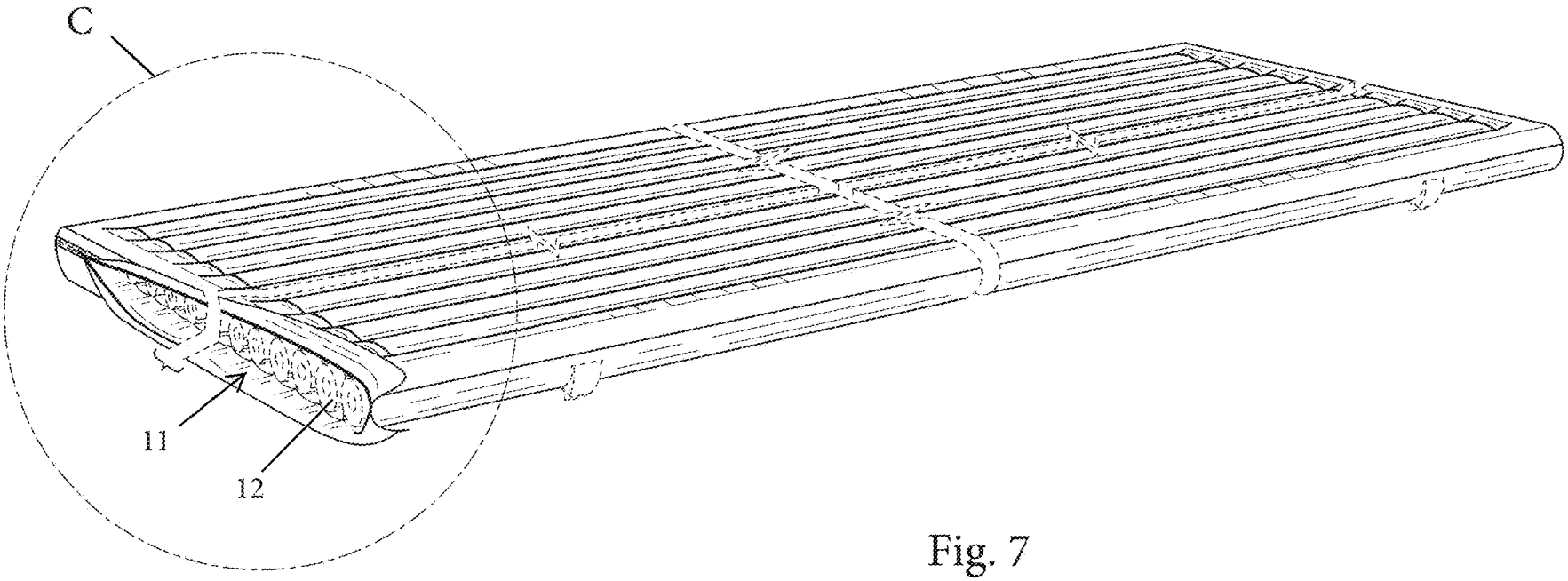
FIG. 7 is a perspective view of a floatation device according to another embodiment of the present disclosure.
Figure 8:
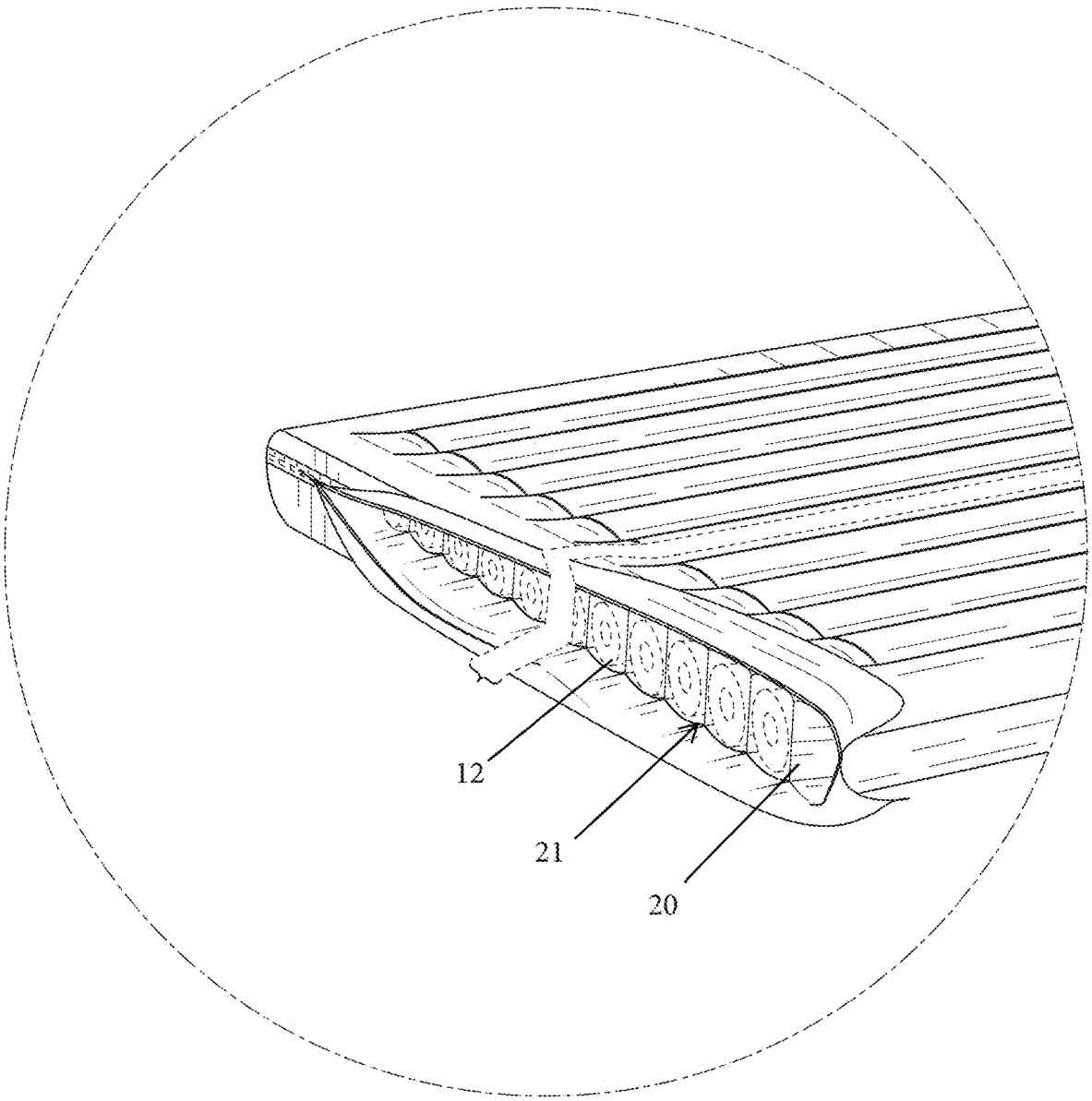
FIG. 8 is a detail view showing area C of FIG. 7.
Figure 9:
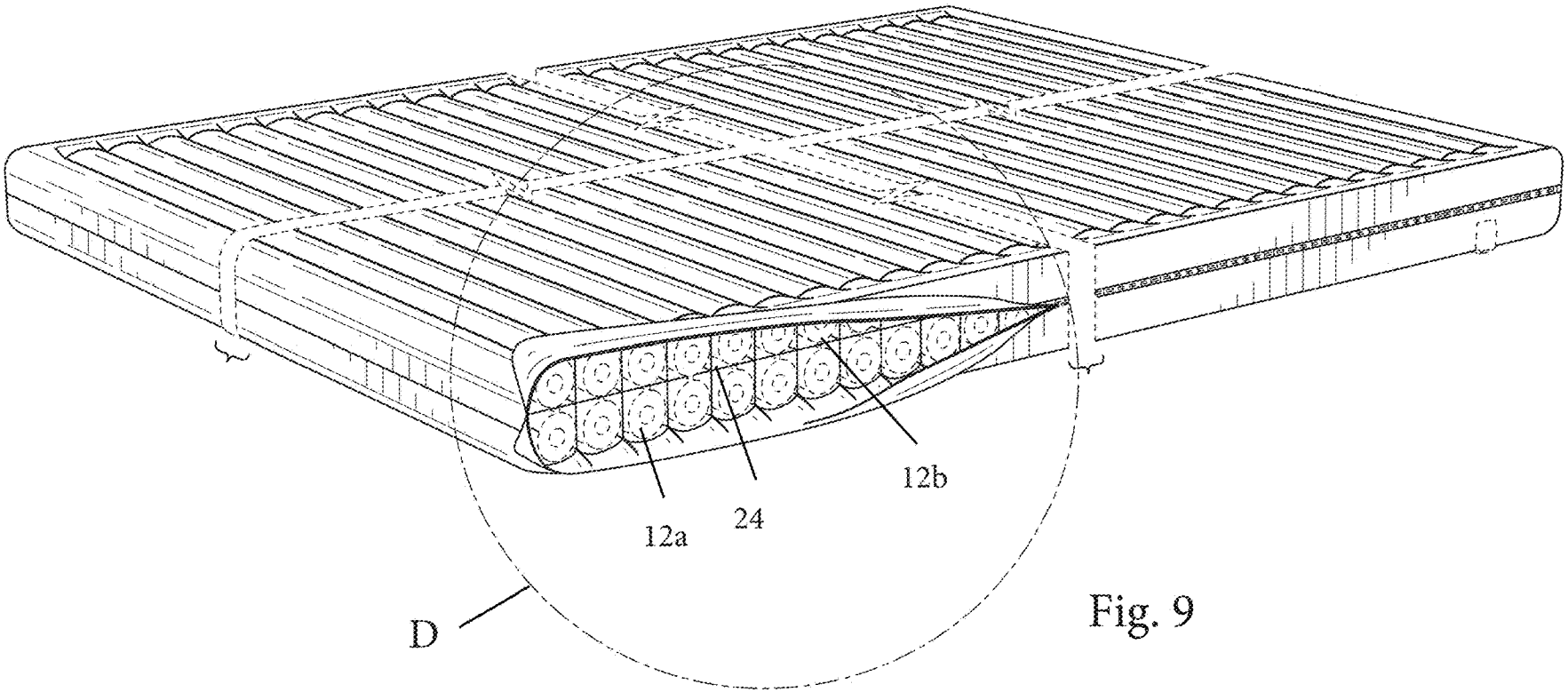
FIG. 9 is a perspective view of a floatation device according to another embodiment of the present disclosure.
Figure 10:
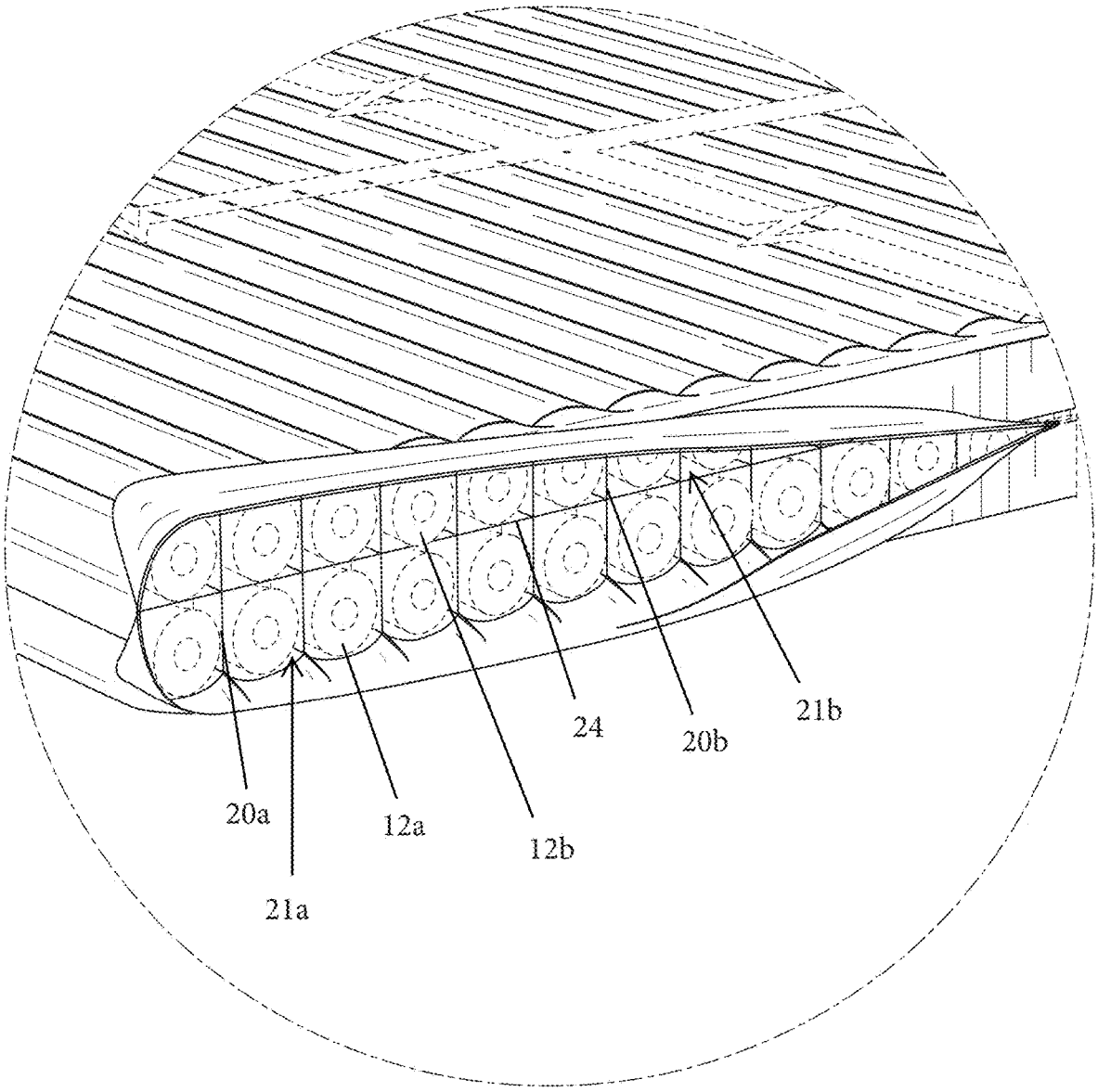
FIG. 10 is a detail view showing area D of FIG. 9.
Figure 11:
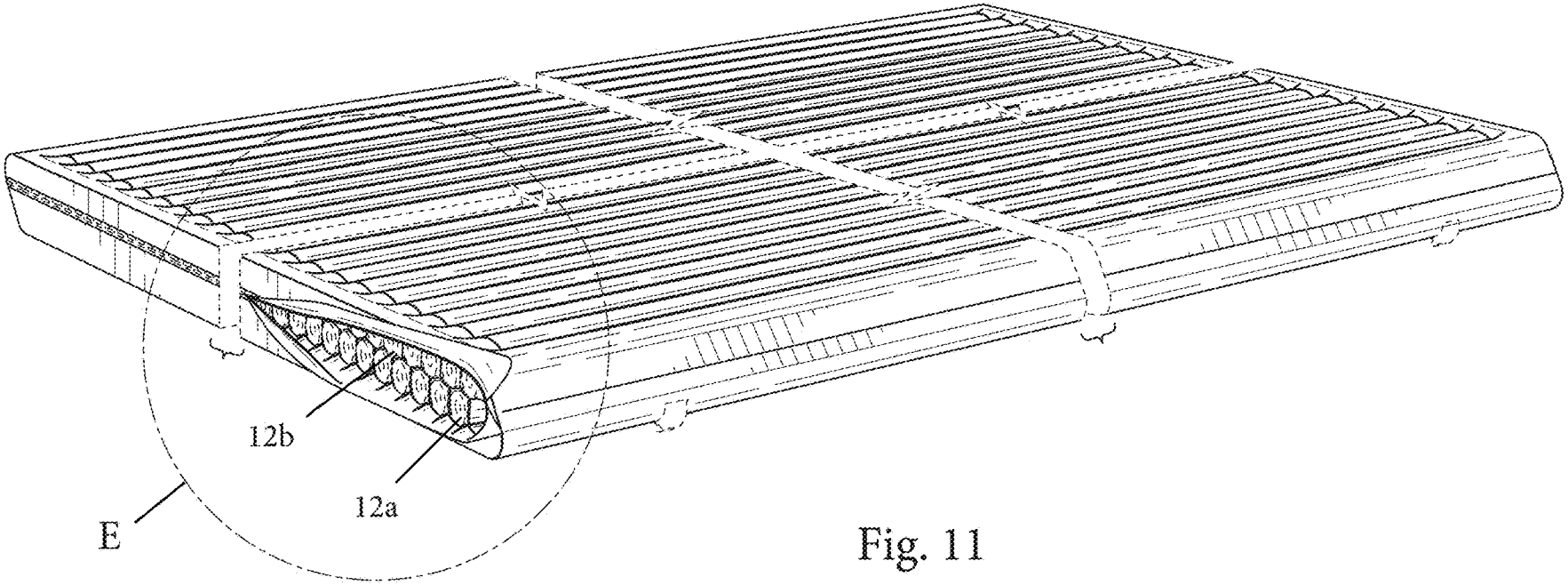
FIG. 11 is a perspective view of a floatation device according to another embodiment of the present disclosure.
Figure 12:
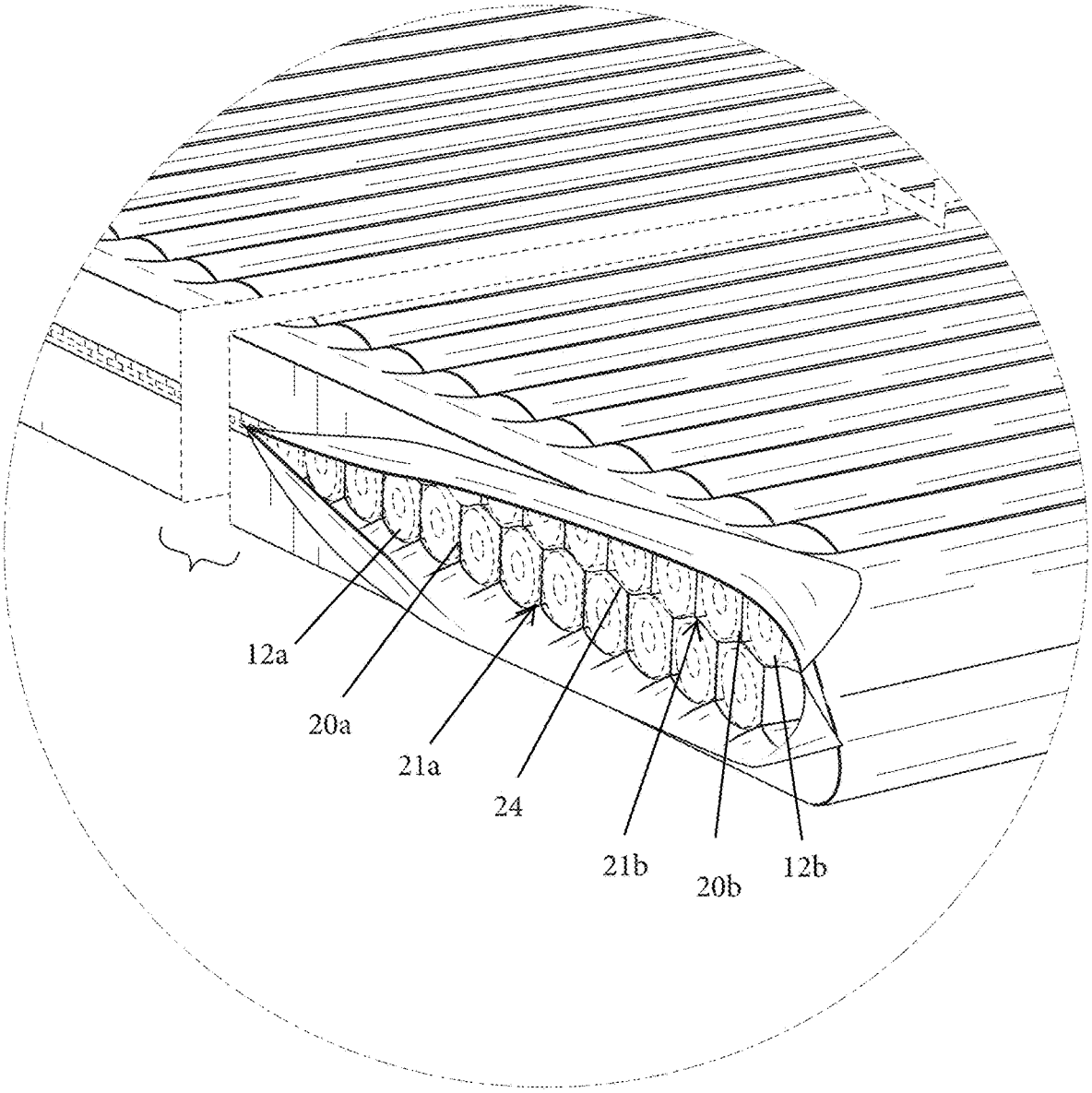
FIG. 12 is a detail view showing area E of FIG. 11.
Figure 13:
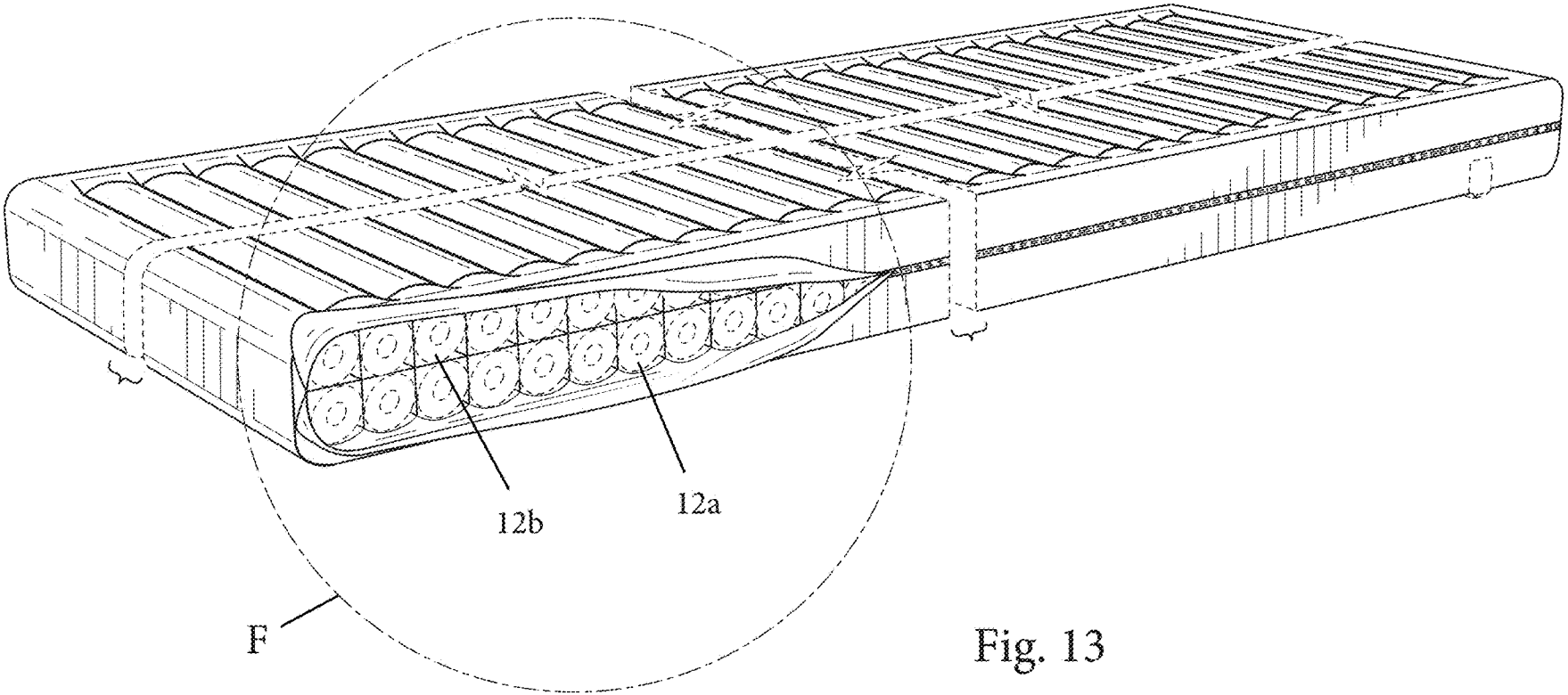
FIG. 13 is a perspective view of a floatation device according to another embodiment of the present disclosure.
Figure 14:
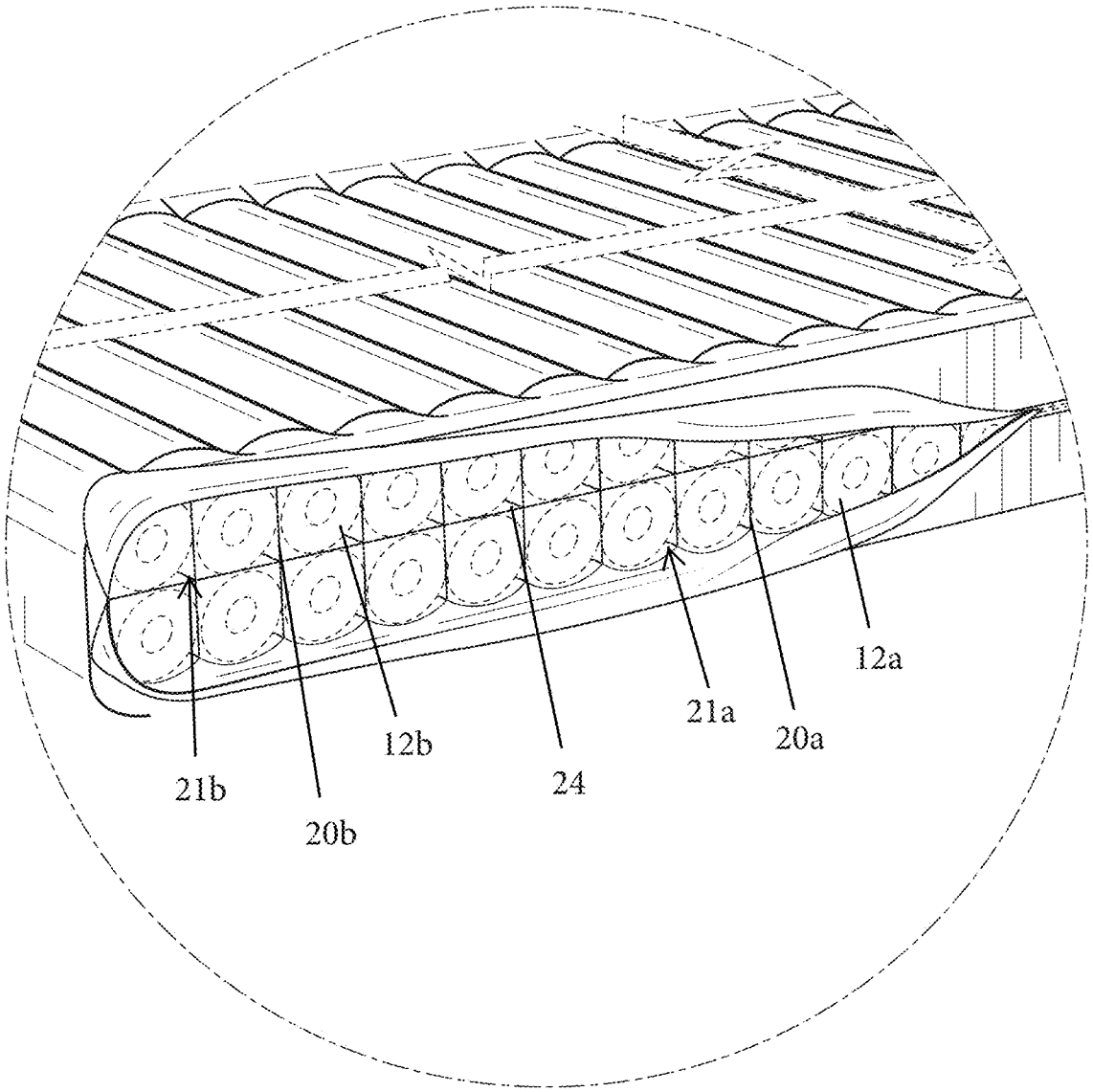
FIG. 14 is a detail view showing area F of FIG. 13.
Figure 15:
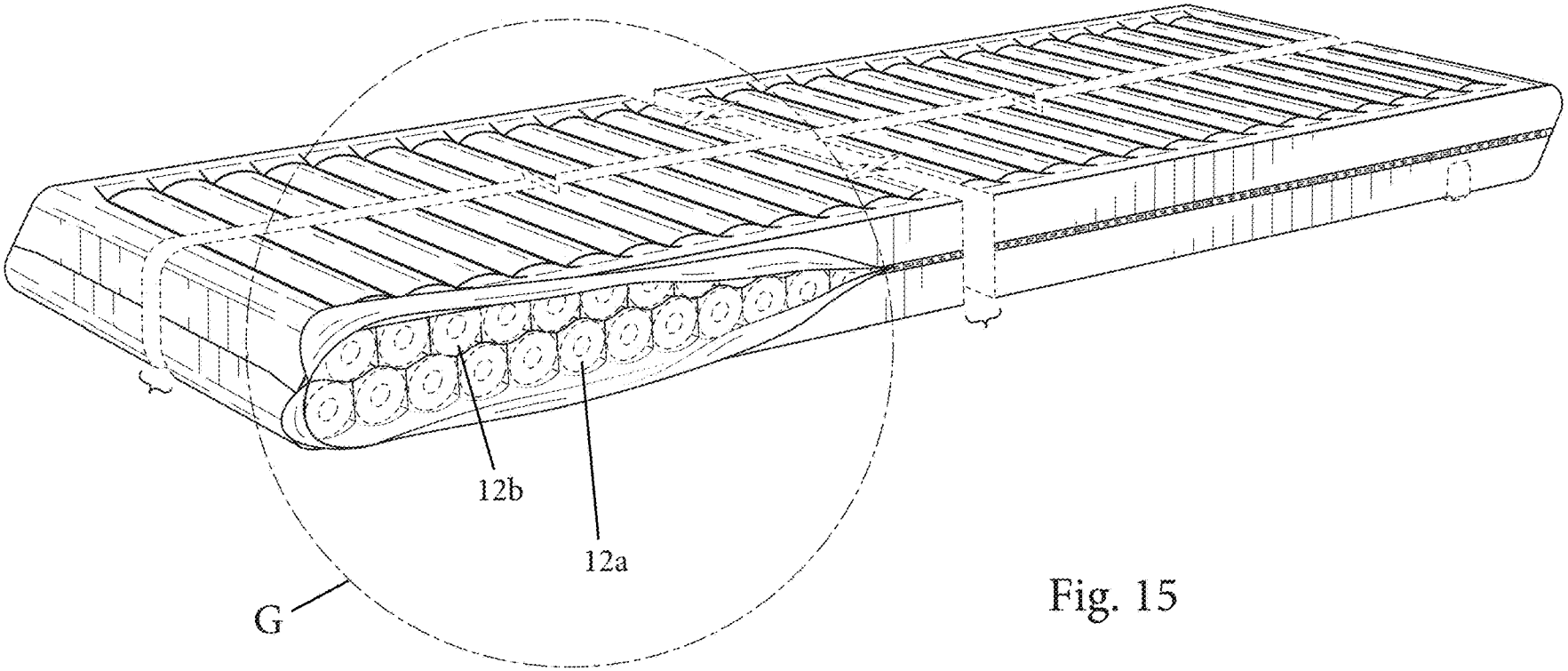
FIG. 15 is a perspective view of a floatation device according to another embodiment of the present disclosure.
Figure 16:
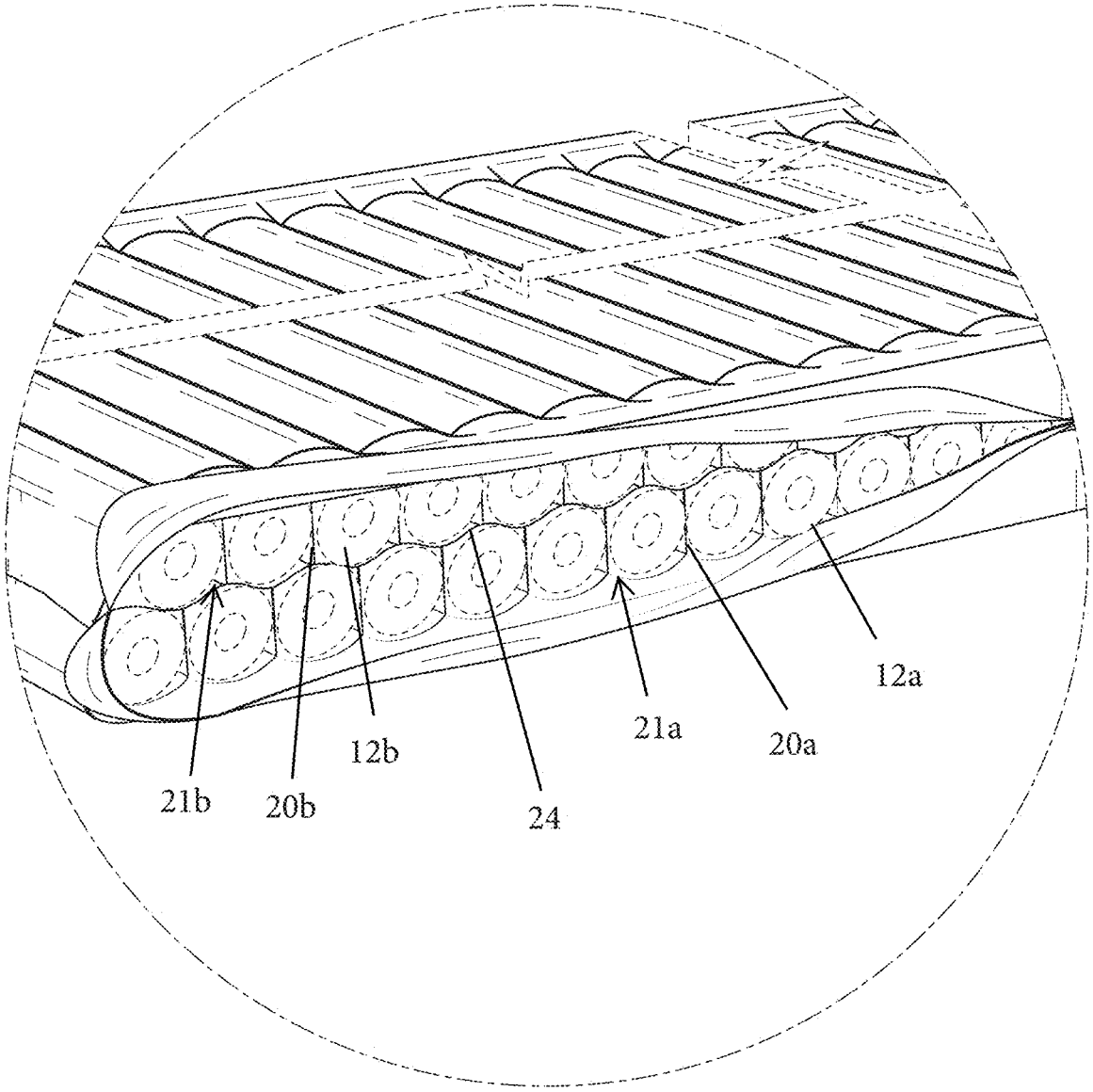
FIG. 16 is a detail view showing area G of FIG. 15.
Figure 17:
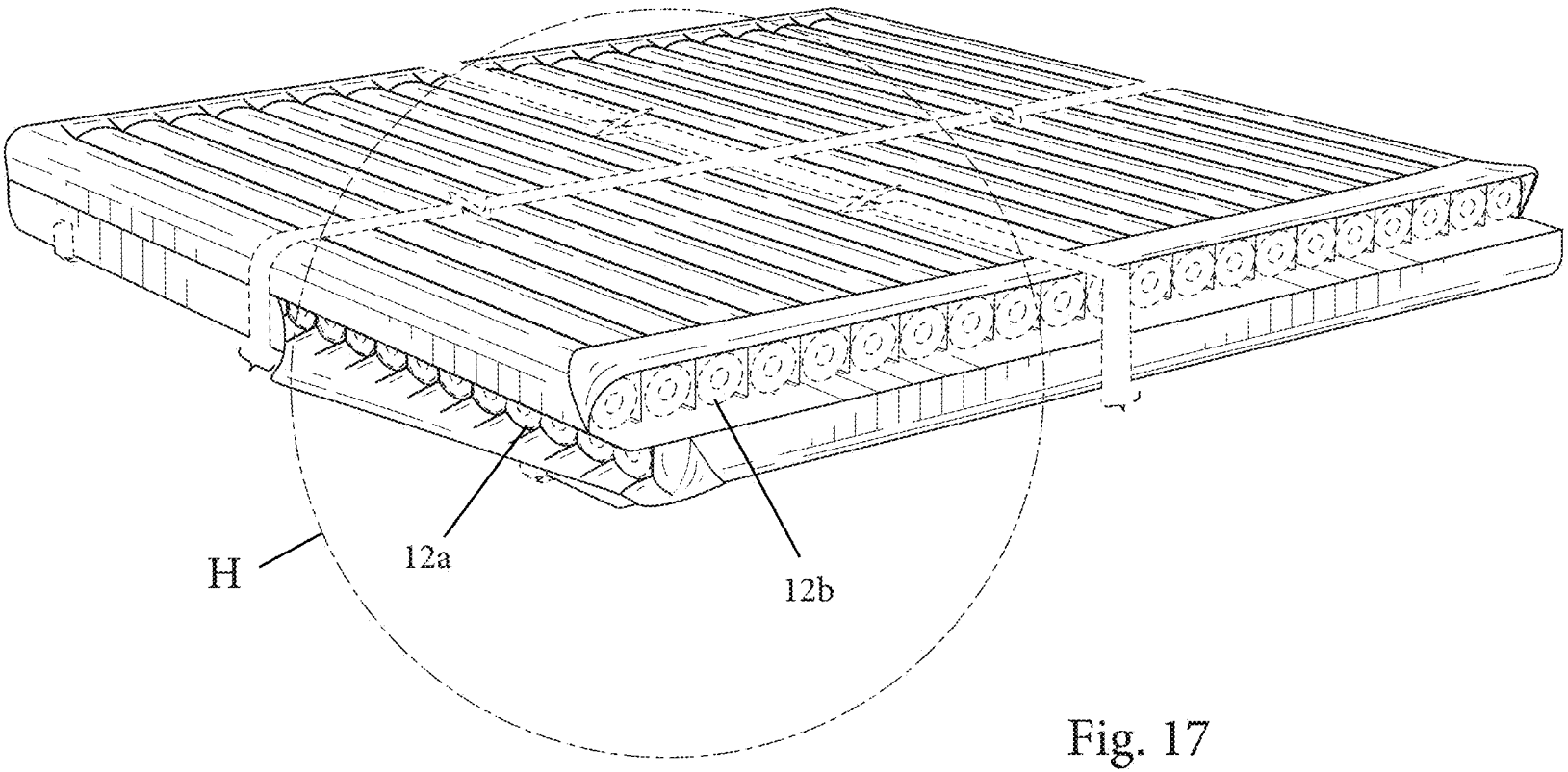
FIG. 17 is a perspective view of a floatation device according to another embodiment of the present disclosure.
Figure 18:
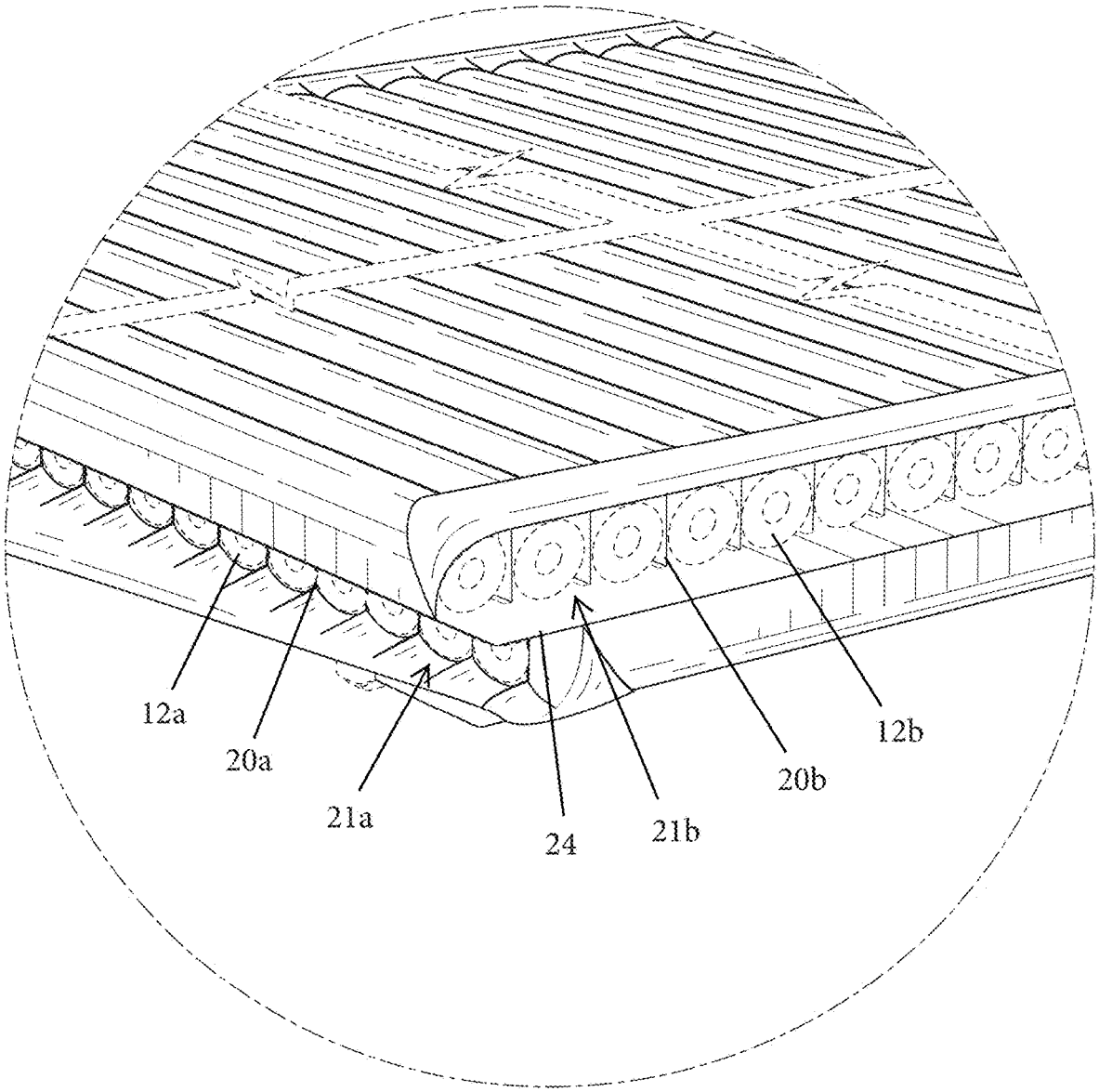
FIG. 18 is a detail view showing area H of FIG. 17.

According to the embodiment depicted in FIGS. 1-6, the plurality of dividers 20 may extend the width of the casing 10, and the plurality of foam floatation members 12 may be arranged transversely in the chamber 11. Alternatively, as illustrated in FIGS. 7 and 8, the plurality of dividers 20 may extend the length of the casing 10, and the plurality of foam floatation members 12 may be arranged longitudinally in the chamber 11.

The floatation device 1 of the present disclosure provides a floating platform comprised of a plurality of foam floatation members 12. The plurality of foam floatation members 12 can provide sufficient buoyancy to serve as a pool float in a body of water. The plurality of foam floatation members 12 are retained within the chamber 11 of the casing 10 for structural rigidity when supporting the body weight of an individual. In addition, the plurality of foam floatation members 12 may be easily removed from the casing 10 by opening the chamber 11 via the zipper 18. This allows the components of the floatation device 1 to be separated for ease of transport. Also, each of the plurality of foam floatation members 12 can be separately replaced if their condition deteriorates over time. This allows the individual to keep the floatation device 1 longer, as its functionality and appearance can be easily maintained. The plurality of foam floatation members 12 are readily available in various lengths and sizes for ease of replacement.

The flotation device 1 can further include one or more retaining mechanisms 30 (illustrated with broken lines) so that the flotation device 1 can be interconnected to additional flotation devices 1. For example, the flotation device can include two retaining mechanisms 30 on each side of the casing 10. Examples of retaining mechanisms 30 include buckles, snaps, fasteners, and the like.

FIGS. 9-18 depict embodiments of the present disclosure in which the plurality of foam floatation members 12 includes a first layer of foam floatation members 12*a* and a second layer of foam floatation members 12*b*. The second layer of foam floatation members 12*b* may be disposed on top of the first layer of foam floatation members 12*a*. One of the foam floatation members from the first layer 12*a* and one of the foam floatation members from the second layer 12*b* may be positioned in each of the plurality of sleeves 21.

According to an embodiment of the present disclosure, a separation layer 24 may be disposed between the first layer of foam floatation members 12*a* and the second layer of foam floatation members 12*b*. The separation layer may be connected to the plurality of dividers 20, and may be the same material as the plurality of dividers 20.

The plurality of dividers 20 may comprise a first layer of dividers 20*a* and a second layer of dividers 20*b*. The first layer of dividers 20*a* may be connected at a first end to the lower porous layer 16 and at a second end to the separation layer 24. The second layer of dividers 20*b* may be connected at a first end to the separation layer and at a second end to the upper fabric layer 14. The separation layer may divide the plurality of sleeves 21 into a first layer of sleeves 21*a* and a second layer of sleeves 21*b*. The first layer of foam floatation members 12*a* may be positioned in the first layer of sleeves 21*a*, and the second layer of foam floatation members 12*b* may be positioned in the second layer of sleeves 21*b*.

According to an embodiment of the present disclosure (e.g., shown in FIGS. 9-10 and 13-14), the first layer of sleeves 21*a* may be aligned with the second layer of sleeves 21*b*. For example, the position of the first layer of dividers 20*a* may mirror the position of the second layer of dividers 20*b* on the other side of the separation layer 24. Thus, the first layer of foam floatation members 12*a* and the second layer of foam floatation members 12*b* may be aligned in the casing 10. In this embodiment, the casing 10 may be a substantially rectangular prism.

According to an embodiment of the present disclosure (e.g., shown in FIGS. 11-12 and 15-16), the first layer of sleeves 21*a* may be offset with the second layer of sleeves 21*b*. For example, the position of the first layer of dividers 20*a* may be offset from the position of the second layer of dividers 20*b* on the other side of the separation layer 24. Thus, the first layer of foam floatation members 12*a* and the second layer of foam floatation members 12*b* may be offset in the casing 10. In this embodiment, the casing 10 may be a parallelepiped or a trapezoidal prism.

According to an embodiment of the present disclosure (e.g., shown in FIGS. 17-18), the first layer of sleeves 21*a* may be orthogonal to the second layer of sleeves 21*b*. For example, the first layer of dividers 20*a* may extend across the width of the casing 10 and the second layer of dividers 20*b* may extend across the length of the casing 10. Alternatively, the first layer of dividers 20*a* may extend across the length of the casing 10 and the second layer of dividers 20*b* may extend across the width of the casing 10. Thus, the first layer of foam floatation members 12*a* and the second layer of foam floatation members 12*b* may be orthogonal in the casing 10. In this embodiment, the casing 10 may be a substantially rectangular prism.

Figure 19:
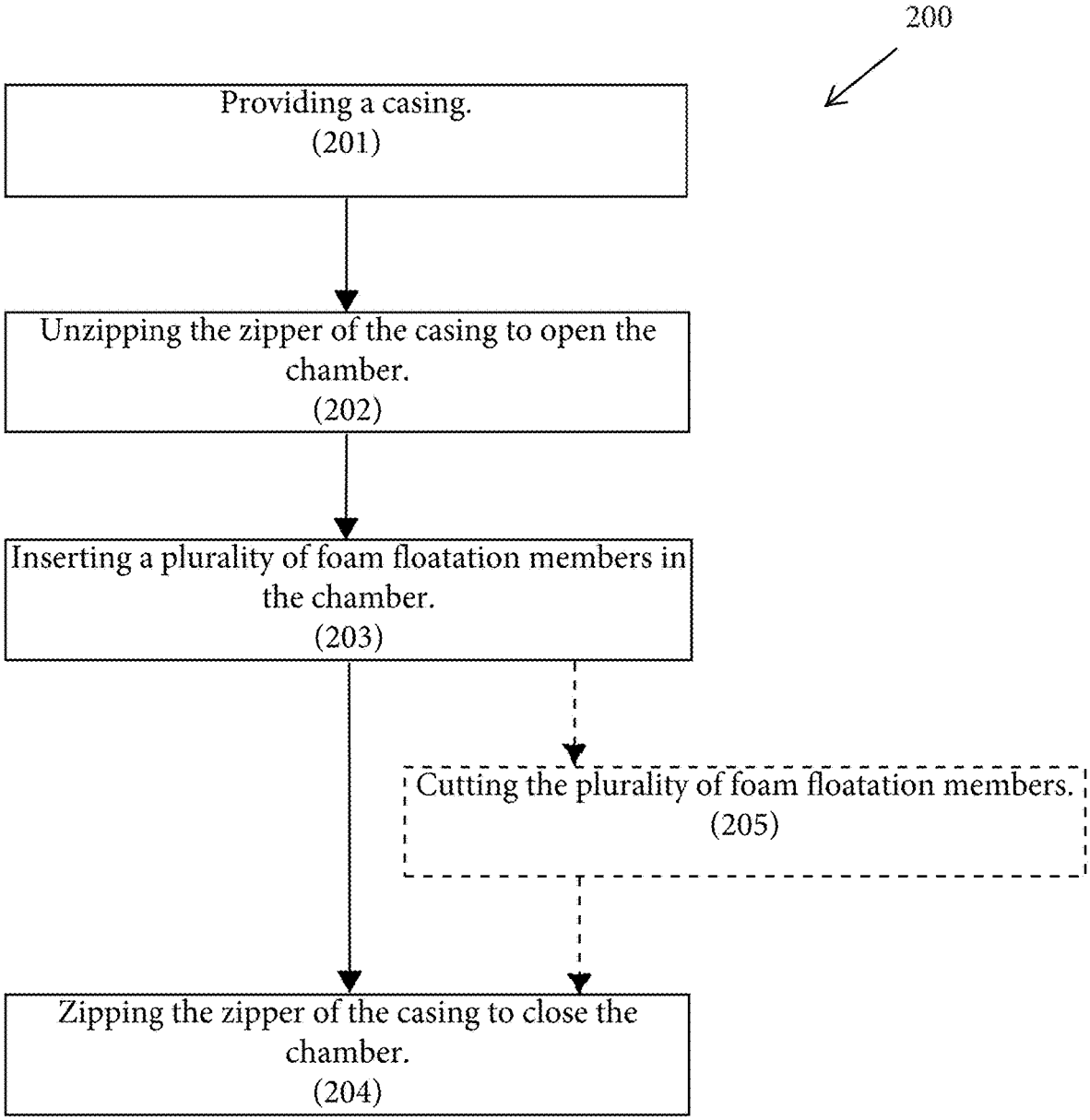
FIG. 19 is a flow chart of a method of assembling a floatation device according to an embodiment of the present disclosure.

With reference to FIG. 19, the present disclosure further provides a method 200 of assembling a floatation device. The method 200 may comprise providing 201 a casing. The casing may comprise an upper fabric layer, a lower porous layer, and a plurality of dividers. A portion of the edges of the upper fabric layer and the lower porous layer may be fixed together and the remaining edges of the upper fabric layer and the lower porous layer may be connected by a zipper. The upper fabric layer and the lower porous layer may define a chamber therebetween. Each of the plurality of dividers may be connected at a first end to the upper fabric layer and at a second end to the lower porous layer. The plurality of dividers may divide the chamber into a plurality of sleeves.

The method 200 may further comprise unzipping 202 the zipper of the casing to open the chamber.

The method 200 may further comprise inserting 203 a plurality of foam floatation members in the chamber. Each foam floatation member may be positioned in one of the plurality of sleeves. The plurality of foam floatation members may be arranged to form a floating platform.

The method 200 may further comprise zipping 204 the zipper of the casing to close the chamber.

According to an embodiment of the present disclosure, before zipping 204 the zipper of the casing, the method 200 may further comprise cutting 205 the plurality of foam floatation members. The plurality of foam floatation members may be readily available for purchase at various lengths. In order for each of the foam floatation members to fit within the casing, the length of each may need be shortened. Thus, the length of the plurality of foam floatation members may be cut before zipping the zipper to close the chamber.

Although the present disclosure has been described with respect to one or more particular embodiments, it will be understood that other embodiments of the present disclosure may be made without departing from the scope of the present disclosure. Hence, the present disclosure is deemed limited only by the appended claims and the reasonable interpretation thereof.

What is claimed is:

1. A method of assembling a floatation device comprising:

providing a casing comprising:

an upper fabric layer;

a lower porous layer, opposite to the upper fabric layer; and a plurality of dividers, each of the plurality of dividers being connected at a first end to the upper fabric layer and at a second end to the lower porous layer;

wherein a portion of edges of the upper fabric layer and portion of edges of the lower layer are fixed together and another portion of edges of the upper fabric layer and the lower fabric layer are connected by a zipper, the upper fabric layer and the lower fabric layer defining a chamber therebetween, and the plurality of dividers dividing the chamber into a plurality of sleeves;

installing a plurality of foam floatation members in a respective sleeve of the plurality of sleeves;

closing the zipper to form a floatatable platform;

wherein the upper fabric layer is a woven, water-resistant fabric;

wherein the lower porous layer includes yarns coated with a synthetic plastic polymer;

wherein the lower porous layer includes apertures that range between 0.5 $mm^2$ and 1.5 $mm^2$.

2. The method of claim 1, wherein the apertures are defined by spacing adjacent yarns of the yarns of the lower porous layer by a distance greater than 0.75 mm.

3. The method of claim 2, wherein the upper fabric layer is a coated nylon or polyester.

4. The method of claim 1, wherein the plurality of foam floatation members are tubular.

5. The method of claim 4, further comprising cutting the plurality of foam floatation members prior to inserting each of the plurality of foam floatation members in the respective sleeve of the plurality of sleeves.

6. A floatation device comprising:

a casing comprising:

an upper fabric layer;

a lower porous layer, opposite to the upper fabric layer; and a plurality of dividers, each of the plurality of dividers being connected at a first end to the upper fabric layer and at a second end to the lower porous layer;

wherein a portion of edges of the upper fabric layer and portion of edges of the lower layer are fixed together and another portion of edges of the upper fabric layer and the lower fabric layer are connected by a zipper, the upper fabric layer and the lower fabric layer defining a chamber therebetween, and the plurality of dividers dividing the chamber into a plurality of sleeves;

wherein the casing is configured to receive a plurality of foam floatation members in the chamber, each foam floatation member being positioned in a respective sleeve of the plurality of sleeves, and the plurality of foam floatation members are arranged to form a floating platform;

wherein the upper fabric layer is a woven, water-resistant fabric;

wherein the lower porous layer includes yarns coated with a synthetic plastic polymer;

wherein the lower porous layer includes apertures that range between 0.5 $mm^2$ and 1.5 $mm^2$.

7. The floatation device of claim 6, wherein the synthetic plastic polymer is polyvinyl chloride.

8. The floatation device of claim 7, wherein the apertures are defined by spacing adjacent yarns of the yarns of the lower porous layer by a distance greater than 0.75 mm.

9. The floatation device of claim 8, wherein the upper fabric layer is a coated nylon or polyester.

10. The floatation device of claim 6, wherein the plurality of foam floatation members are tubular.

11. The floatation device of claim 6, wherein the plurality of foam floatation members are arranged longitudinally in the chamber.

12. The floatation device of claim 6, wherein the plurality of foam floatation members are arranged transversely in the chamber.

13. The floatation device of claim 6, wherein the plurality of foam floatation members comprises:

a first layer of foam floatation members; and a second layer of foam floatation members disposed on top of the first layer of foam floatation members.

14. The floatation device of claim 13, wherein a separation layer is disposed between the first layer of foam floatation members and the second layer of foam floatation members, and the separation layer is a same material as the plurality of dividers.

15. The floatation device of claim 14, wherein the plurality of dividers comprises:

a first layer of dividers each connected at a first end to the lower porous layer and at a second end to the separation layer; and a second layer of dividers each connected at a first end to the separation layer and at a second end to the upper fabric layer;

wherein each foam floatation member in the first layer of foam floatation members is adjacent to at least one divider of the first layer of dividers, and each foam floatation member in the second layer of foam floatation members is adjacent to at least one divider of the second layer of dividers.

16. The floatation device of claim 14, wherein the second layer of foam floatation members are stacked on the first layer of foam floatation members such that the first layer of foam floatation members and the second layer of foam floatation members are aligned.

17. The floatation device of claim 14, wherein the second layer of foam floatation members are stacked on the first layer of foam floatation members such that the first layer of foam floatation members and the second layer of foam floatation members are offset.

18. The floatation device of claim 14, wherein the second layer of foam floatation members are stacked on the first layer of foam floatation members such that the first layer of foam floatation members and the second layer of foam floatation members are arranged orthogonal relative to one another.

19. A floatation device comprising:

a casing comprising:

an upper fabric layer;

a lower porous layer, opposite to the upper fabric layer; and a plurality of dividers, each of the plurality of dividers being connected at a first end to the upper fabric layer and at a second end to the lower porous layer;

wherein a portion of edges of the upper fabric layer and portion of edges of the lower layer are fixed together and another portion of edges of the upper fabric layer and the lower fabric layer are connected by a zipper, the upper fabric layer and the lower fabric layer defining a chamber therebetween, and the plurality of dividers dividing the chamber into a plurality of sleeves;

wherein the casing is configured to receive a plurality of foam floatation members in the chamber, each foam floatation member being positioned in a respective sleeve of the plurality of sleeves, and the plurality of foam floatation members are arranged to form a floating platform;

wherein the upper fabric layer is a woven, water-resistant fabric;

wherein the lower porous layer includes yarns coated with a synthetic plastic polymer;

wherein the plurality of foam floatation members comprises:

a first layer of foam floatation members; and a second layer of foam floatation members disposed on top of the first layer of foam floatation members.

* * * * *